US006863622B1

(12) United States Patent
Hsu

(10) Patent No.: US 6,863,622 B1
(45) Date of Patent: Mar. 8, 2005

(54) GOLF CLUB HEAD WITH ADJUSTABLE TILT MECHANISM

(76) Inventor: Hsin I Hsu, 10F.-1, No. 58, Sec. 3, Chengde Rd., Taipei City 103 (TW)

( * ) Notice: Subject to any disclaimer, the term of this patent is extended or adjusted under 35 U.S.C. 154(b) by 6 days.

(21) Appl. No.: 10/653,195

(22) Filed: Sep. 3, 2003

(51) Int. Cl.[7] ..... A63B 53/02
(52) U.S. Cl. ..... 473/307; 473/306
(58) Field of Search ..... 473/305–315, 473/244–248

(56) References Cited

U.S. PATENT DOCUMENTS

| | | | | | |
|---|---|---|---|---|---|
| 1,765,982 | A | * | 6/1930 | Keating | 473/248 |
| 2,007,976 | A | * | 7/1935 | Kraeuter | 473/305 |
| 2,067,556 | A | * | 1/1937 | Wettlaufer | 473/308 |
| 4,948,132 | A | * | 8/1990 | Wharton | 473/246 |
| 4,984,794 | A | * | 1/1991 | Pernelle et al. | 473/309 |
| 5,362,048 | A | * | 11/1994 | Haste | 473/313 |
| 5,577,726 | A | * | 11/1996 | Fenton | 473/305 |
| 5,851,155 | A | * | 12/1998 | Wood et al. | 473/246 |
| 5,951,411 | A | * | 9/1999 | Wood et al. | 473/307 |
| 6,110,055 | A | * | 8/2000 | Wilson | 473/239 |
| 6,273,828 | B1 | * | 8/2001 | Wood et al. | 473/246 |
| 6,575,843 | B2 | * | 6/2003 | McCabe | 473/245 |
| 6,769,994 | B2 | * | 8/2004 | Boone | 473/245 |

FOREIGN PATENT DOCUMENTS

| | | | | |
|---|---|---|---|---|
| GB | 2207358 A | * | 2/1989 | A63B/53/02 |
| GB | 2301041 A | * | 11/1996 | A63B/53/06 |
| JP | 2003070940 A | * | 3/2003 | A63B/53/02 |

* cited by examiner

*Primary Examiner*—Gregory Vidovich
*Assistant Examiner*—Alvin A. Hunter, Jr.
(74) *Attorney, Agent, or Firm*—Rabin & Berdo, P.C.

(57) ABSTRACT

This invention relates to a golf club head with an adjustable tilt mechanism which is designed to be mounted between a shaft and a head. Simply speaking, the neck of the head forms a long adjusting cavity and the shaft is held in the long adjusting cavity of the head by the pivot but pin permitting left or right swing. The shaft is further locked in the lock ring and clamped in place by the tie land and tie slot carved on the head to retain the shaft fast within the long adjusting hole of the head. This mechanism permits an adequate adjustment of tilt angle (an angle of elevation) of the face. At the case of a long flight of ball striking, the face at a desirable tilt angle will render the ball a low or high parabola along the flight course to fly over the obstacle.

4 Claims, 3 Drawing Sheets

GOLF CLUB HEAD WITH ADJUSTABLE TILT MECHANISM

FIELD OF THE INVENTION

This invention concerns the adjustable tilt mechanism for the golf club in which the adjustable tilt mechanism is designed to mount between a shaft and a head, capable of changing the tilt angle of the face, easy for the golf player to strike the club and render the ball a flight a low or a high parabola to shun away the obstacle.

BACKGROUND OF THE INVENTION

FIGS. 1 and 2 show the schematic diagrams of the prior art of a golf club that is very popular in use containing a head 10 and a vertically formed neck 11. The head has a variety of sizes and the face 12 and the neck 11 are linked in different angle. The neck 11 has a cavity 13 to receive a hosel 15 and a shaft 14 which is glued fast in the cavity 13. Besides the difference in sizes, the shaft length and gravity, the angle formed between the face 12, and the shaft 14 varies greatly too. Simply speaking, when the angle formed between the face 12 and the shaft 14 is wide obtuse, the ball will fly low parabola course. Each golf bag will at least contains the iron clubs No. 1, 2, 3, 4, 5, 6, 7, 8, 9, P and 9, total nine clubs and the wood clubs No. 1, 3 and 5, three wood clubs in order to strike the ball to the green with least number of strokes. In reality, in most case in 18 holes play, because of poor control over the ball flight, the ball occasionally falls behind the obstacle (big tree) which stands between the ball and the green. Under this circumstance, the seasoned player would change his stance and the iron club with a acute angle face, so the ball being struck would fly a high parabola flight over the obstacle, or he would change his stance and uses the large-number iron club with small angle to strike the ball flying a low parabola to penetrate through the obstacle. From the above statement, it is learned that the angle form between the face 12 of the head 10 and the shaft 14 is a critical factor to make a ball a low parabola or high parabola flight. The adjustable tilt mechanism is provided between the head and the shaft, for the unskillful player, it is easy way to promote his golf playing interest. This serves the purpose the inventor wants to design this adjustable tilt mechanism.

SUMMARY OF THE INVENTION

Because all golf clubs are formed at a fixed angle between the head and the shaft, it is extremely hard for the unskillful golf player to pick the right club to hit the right parabola for the ball. For this reason, the inventor, for long experience in manufacturing golf club and wide observation, has begun to come up this invention with many trials and errors. This invention designs an inverted conical long hole in the neck; the lower end of the shaft passes the retaining ring and the hosel and enters into the long adjustable hole in the neck to be locked by the lock pin with the neck. However the shaft is so permitted to swing to left or to right as to change the angle (elevation angle) between the face and the shaft but still held firmly by the retaining ring and adjustable hole in the neck.

BRIEF DESCRIPTION OF THE DRAWINGS

FIG. 3-1 shows the side view of an adjustable tilt mechanism of a club shaft of this invention.

FIG. 3-2 shows the bottom view of an adjustable tilt mechanism of a club shaft of this invention.

DETAILED DESCRIPTION OF THE INVENTION

Figure 2:
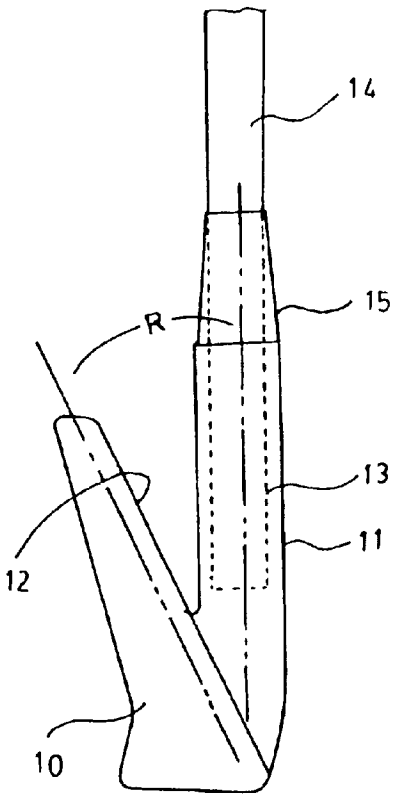
FIG 2 PRIOR ART
FIG. 2 shows an assembly view of the prior art of the golf club.
Figure 1:
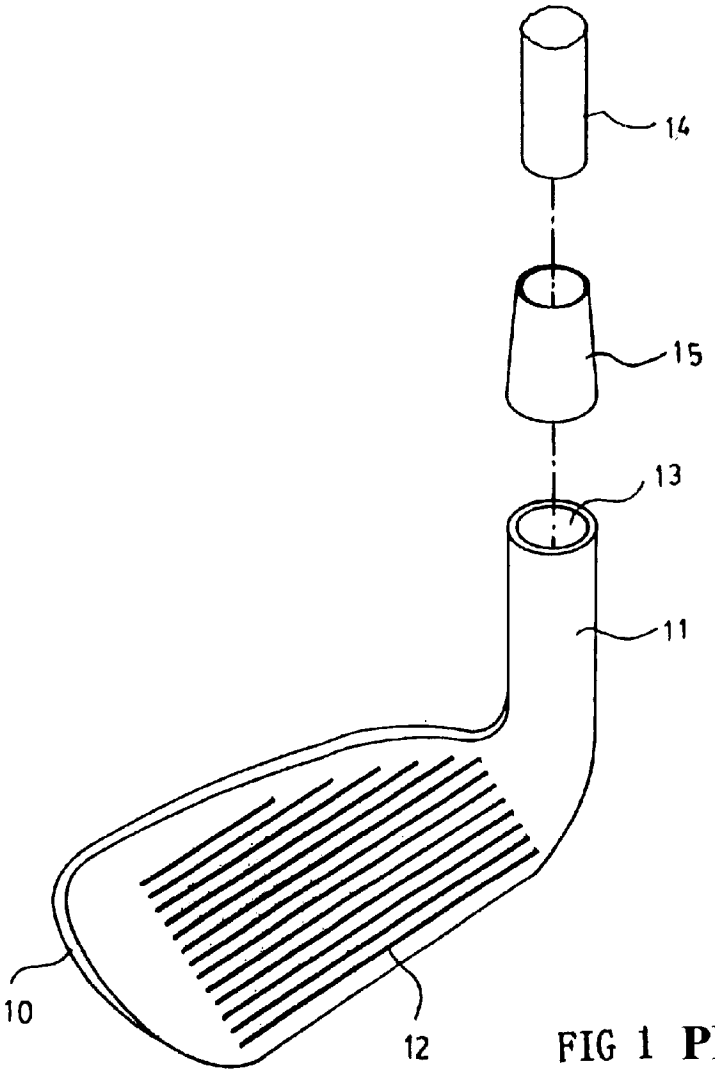
FIG 1 PRIOR ART
FIG. 1 shows an appearance of the prior art of the golf club.

This invention will be explained in great detail with the aid of a plurality of embodiments as illustrated in the drawings attached.

Figure 3:
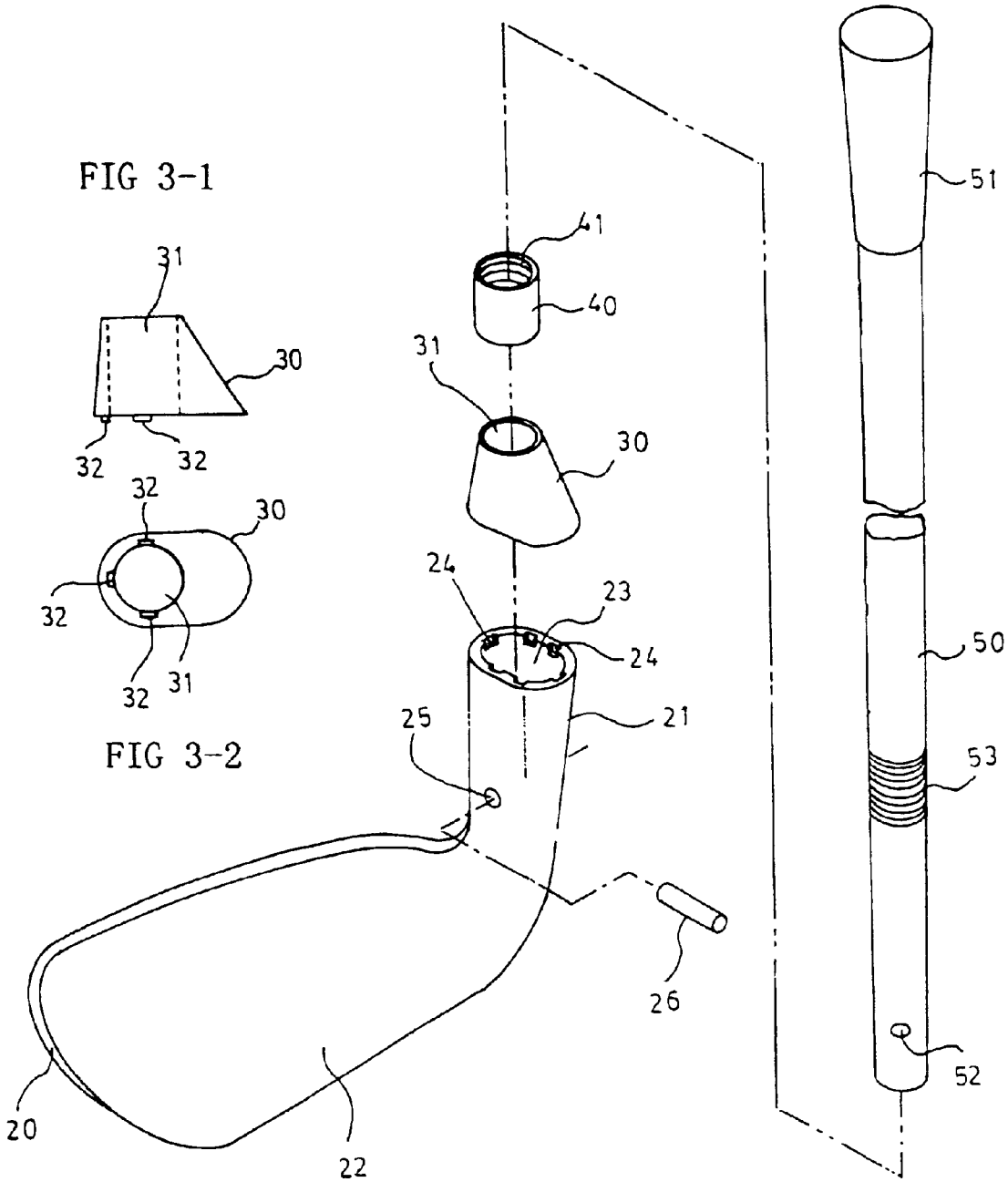
FIG. 3 shows a disassembly view of an adjustable tilt mechanism of a club shaft of this invention.

FIG. 3 shows a disassembly view of an adjustable tilt mechanism of this invention wherein the adjustable tilt mechanism comprises a head 20, a hosel 30, a retaining ring 40, and a shaft 50.

As shown in the prior art of golf club, the head 20 is vertically formed with the neck 21. The head 20 is numbered in size and each size has a specified tilt formed between the face 22 and the neck 21. But in this invention, the neck 21 of the head 20 provides a long adjustable hole 23 which has a wide opening and narrow bottom. The opening rim has a plurality of tie slots 24 distributed at a specific angle. A through lock hole 35 is drilled at the lower part of the neck 21 to receive the lock pin 26 so as to lock the shaft 50 in the long adjustable hole 23.

The hosel 30 has a longitudinal hollow 31 in which inner diameter equals to the outer diameter of the shaft 50. The bottom face of the hosel 30 is in the similar shape of the neck top 21 of the head 20. Along the inner rim of the hosel 30, there are three tie lands 32.

The retaining ring 40 has an inner thread 41.

The shaft 50, as similar to that in the prior art of golf club, has a handle 51 and a lock hole 52 at the lower end and a thread section 52 in the middle section of the shaft 50.

Figure 6:
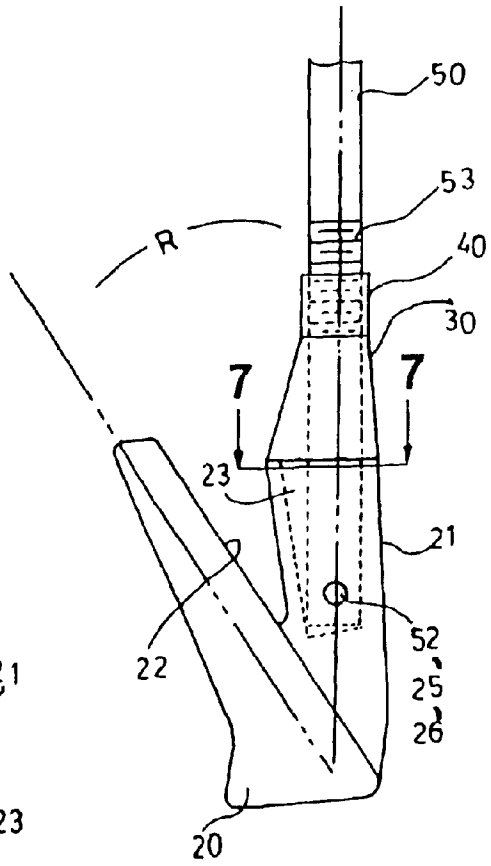
FIG. 6 shows a schematic diagram of the adjustment of a large elevation angle in the adjustable tilt mechanism of the club shaft of this invention.
Figure 4:
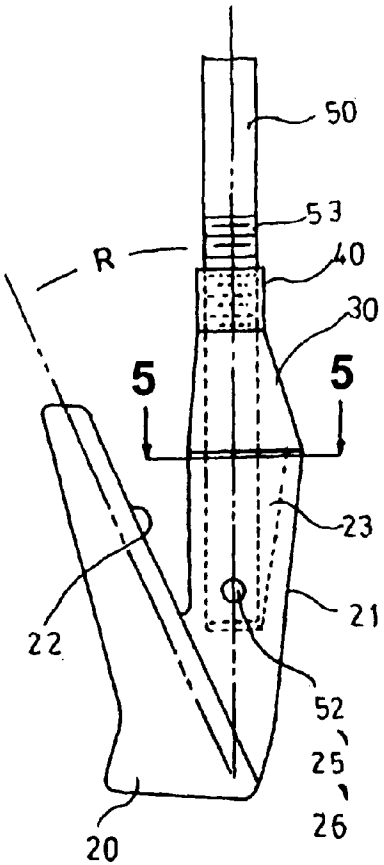
FIG. 4 shows a schematic diagram of the adjustment of a small elevation angle in the adjustable tilt mechanism of the club shaft of this invention.

Please refer to FIGS. 4 and 6 which show the adjustable tilt mechanism. First, the inner thread 41 of the retaining ring 40 is fitted in the thread section 53 of the shaft 50. The opening 31 of the hosel 30 will receive the shaft 50 section exposed under the retaining ring 40. When the lower end of the shaft 50 enters into the long adjustable hole 23 of the neck 21 of the head 20, the lock pin 26 will pass the lock hole 23 on the neck 21 and the lock hole 52 of the shaft 50. At this moment, the shaft 50 is permitted to swing to left or to right pivoted on the lock pin 26 within the adjustable hole 23 of the neck 21 to change the tilt (elevation angle) formed between the face 22 of the head 20 and the shaft 50.

Figure 5:
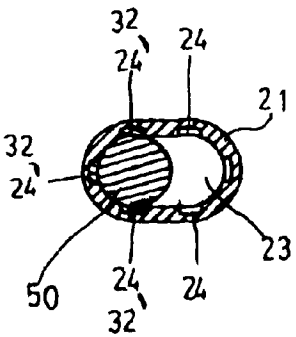
FIG. 5 is a cross section view taken along lines 5—5 of FIG. 4.

Please refer to FIGS. 4 and 5; when the shaft 50 is swung to left in the adjustable hole 23 of the neck 21, the elevation angle formed between the face 22 of the head 20, and the shaft 60 decreases. When the hosel 30 is pressed downward to the neck 21 of the head 20, the tie land 32 on the hosel opening 31 will be inserted into the tie slot 24 of the adjustable hole 23 (as shown in a closed position of FIG. 5), the shaft 50 along the retaining ring 40 and thread section 52 will move downward to hold the shaft 50 constantly fixed at the left position in the adjustable hole 23.

Figure 7:
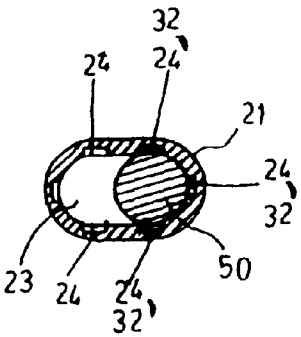
FIG. 7 is a cross section view taken along lines 7—7 of FIG. 6.

As shown in FIGS. 6 and 7, if it is intended to increase the elevation angle between the face 22 of the head 20 and the shaft 50, the threaded section 53 and the retaining ring 40 are moved backward, so the hosel 30 will slide upward, and the tie land 32 of the hesel 30 will leave the tie slot 24 in the adjustable hole 23, so the lock pin 26 and the shaft 50 are free to swing to the right side. When the hosel 30 is pressed downward to the neck top 21 of the head 20, the tie land 32 of the hosel opening 31 enters into the tie slot 24 in the adjustable hole 23 (as shown in the closed position of FIG. 7), the retaining 40 and the threaded section 53 of the shaft 50 press on the adjustable hole 23 to hold the shaft 50 constantly fixed at the right position.

The above statement indicates that the adjustable tilt mechanism of the golf club is easy to adjust the elevation angle formed between the face of the head and the shaft which will render the ball a low or high parabola flight as the player desires to shun away the obstacle.

Many changes and modifications in the above disclosed embodiment of the invention can, of course, be carried out without departing from the scope thereof, such the shape of the long adjustable hole the number of the tie land and tie slot as desirable. Accordingly, to promote the progress in science and the useful arts, the invention is disclosed and is intended to be limited only by the scope of the appended claims.

I claim:

1. An adjustable tilt mechanism for the golf club head comprising a clubhead having a vertically formed neck wherein the neck comprising a long conic adjustable hole with wide opening and narrow bottom, the opening having an opening rim with a plurality of tie slots distributed at a predetermined angle, and a lower end of the adjustable hole having a lock hole and a lock pin, wherein the club head has a size and specific tilt angle formed between the neck and club face associated with the size, a hollow hosel having a bottom rim wherein the hosel has a plurality of tie lands equally disposed at the bottom rim, a shaft having a handle at a top end of the shaft, a threaded section at a middle portion of the shaft, and an additional lock hole at the lower end of the shaft, wherein the shaft is inserted into the adjustable hole and is locked in place by the locking pin, and a retaining ring attached to the threaded section of the shaft, wherein the hosel is disposed at a lower end of the retaining ring.

2. The adjustable tilt mechanism as in claim 1, wherein the hosel has a bottom shaped to coincide with the opening rim of the adjustable hole.

3. The adjustable tilt mechanism as in claim 1, wherein the tie slots on the opening rim are fitted by the tie lands of the hosel.

4. The adjustable tilt mechanism as in claim 1, wherein the tie slots and the tie lands hold the shaft in the adjustable hole.

* * * * *